US010533377B2

(12) United States Patent
Fontana et al.

(10) Patent No.: US 10,533,377 B2
(45) Date of Patent: Jan. 14, 2020

(54) DETECTING SYSTEM IN A SOIL DRILLING MACHINE AND RELATED METHOD

(71) Applicant: SOILMEC S.P.A., Cesena (FC) (IT)

(72) Inventors: Pietro Fontana, Cesena (IT); Ivano Guerra, Cesena (IT); Claudio Benzi, Castiglione di Ravenna (IT)

(73) Assignee: SOILMEC S.P.A., Cesena (FC) (IT)

( * ) Notice: Subject to any disclaimer, the term of this patent is extended or adjusted under 35 U.S.C. 154(b) by 65 days.

(21) Appl. No.: 15/980,183

(22) Filed: May 15, 2018

(65) Prior Publication Data

US 2018/0334856 A1 Nov. 22, 2018

(30) Foreign Application Priority Data

May 16, 2017 (IT) ..... 102017000052986

(51) Int. Cl.

| | |
|---|---|
| ***E21B 17/02*** | (2006.01) |
| ***E21B 47/09*** | (2012.01) |
| ***E21B 7/02*** | (2006.01) |
| *E21B 15/04* | (2006.01) |

(52) U.S. Cl.

CPC ..... *E21B 7/023* (2013.01); *E21B 17/028* (2013.01); *E21B 47/09* (2013.01); *E21B 15/045* (2013.01)

(58) Field of Classification Search

CPC combination set(s) only.
See application file for complete search history.

(56) References Cited

U.S. PATENT DOCUMENTS

2014/0151078 A1* 6/2014 Bettini ..... E02D 7/00 173/1

FOREIGN PATENT DOCUMENTS

| | | | |
|---|---|---|---|
| EP | 2672014 | A2 | 12/2013 |
| WO | 2011/012967 | A1 | 2/2011 |
| WO | 2013/040745 | A1 | 3/2013 |

OTHER PUBLICATIONS

Italian Search Report and Written Opinion from Italian Patent Application No. 10-2017-000052986, dated Dec. 22, 2017.

* cited by examiner

*Primary Examiner* — David J Bagnell
*Assistant Examiner* — Yanick A Akaragwe
(74) *Attorney, Agent, or Firm* — Merchant & Gould P.C.

(57) ABSTRACT

A system and method detect at least one mechanical locking position of a drill string in a soil drilling machine. According the system and method, there are: a sensor apparatus which is configured to detect first data indicating the position assumed by the top of the drill string and second data indicating the position assumed by the bottom of the drill string. A control unit calculates the estimated length of the drill string based on the data and to compare the estimated length with a reference length value. A pair of kelly rods is in a mechanical locking position; and a signaling apparatus is configured to signal when the estimated length corresponds to a reference length value.

11 Claims, 4 Drawing Sheets

DETECTING SYSTEM IN A SOIL DRILLING MACHINE AND RELATED METHOD

This application claims benefit of Serial No. 102017000052986, filed 16 May 2017 in Italy and is incorporated herein by reference. To the extent appropriate, a claim of priority is made to the above-disclosed applications.

TECHNICAL FIELD

The invention relates to a system for detecting at least one mechanical locking position of a drill string in a soil drilling machine, and to a relative detecting method.

TECHNOLOGICAL BACKGROUND

When carrying out foundation and soil consolidation drilling, soil drilling machines are used, which usually are self-moving.

The aforesaid type of machines typically has a self-moving structure provided with a frame on support wheels or tracks, lifting winches for drilling accessories, and a rotary turret on a fifth wheel coupled to the support tracks and comprising a cabin as well as control accessories. The rotary turret is usually provided with a power assembly, for example a heat engine or an electric motor, for the cabin, for the control accessories and, typically, for the lifting winches.

This type of machine usually comprises a mast provided with sliding guides where a rotary slides linearly translates, said rotary being associated with the drilling accessories of the machine, for example a drill string or a drilling tool. The rotary, in particular, receives power, for example hydraulic power or electric power, from the power assembly and turns it into a rotary movement adapted to move the drilling tools.

The mast is commonly delimited, at the top, by a head comprising a plurality of pulleys for one or more ropes, through which the lifting winches located on the turret lift or lower the drilling accessories. The latter usually are unconstrained in an axial direction, but not in a radial direction, relative to the rotary, which is provided with an independent lifting/lowering system.

In case large drilling depths are requested, the typically used technical solution is that of applying the drilling tools to a telescopic drill string containing telescopic kelly rods. More in detail, said drill string usually comprises a plurality of kelly rods having a decreasing cross-section and capable of axially sliding inside one another. These kelly rods are structured so as to transmit the rotary motion and the pushing forces, needed to move forward, to one another. When they are installed in the machine, said kelly rods cross the rotary.

Strings of telescopic kelly rods are usually divided into two types: friction kelly rods and mechanical locking kelly rods.

In friction kelly rods, the torque is usually transmitted between the kelly rods by means of engaging organs, for example longitudinal strips welded along the elements making up the kelly rod, both on the inside and on the outside, so that they can engage one another. Therefore, the transmission of the axial thrust between the kelly rods takes place by means of the friction between the strips generated in the presence of torque.

The rotary, then, has a coupling sleeve which is also provided with engaging means, such as a plurality of inner strips adapted to engage corresponding outer strips of the most external kelly rod of the drill string. In this way, the most external kelly rod of the drill string receives the rotary motion from the rotary through the engagement between the strips of the sleeve and the outer strips of the kelly rod, whereas the transmission of the axial thrust takes place through the friction between the strips of the sleeve and the ones of the most external kelly rod, which is generated in the presence of applied torque. In the absence of applied torque, the kelly rods can axially slide relative to one another and the entire drill string can slide relative to the rotary and is moved by a proper flexible element, preferably a cable.

A drawback arising from the use of friction kelly rods lies in the fact that the transmission of thrust from a kelly rod to the other exclusively takes place through the friction between engaging means, such as strips; therefore, the applicable thrust is only the one allowed by the friction that can be generated.

If the thrust limit value is exceeded, the friction is not sufficient any longer and there is a mutual axial sliding between the kelly rods, so that this thrust cannot be unloaded onto the drilling tool.

Also due to the drawback described above, when drilling operations must be carried out in soils having hard layers, rocks or pebble, it is preferable to use strings of mechanical locking telescopic kelly rods.

An example of mechanical locking kelly rods will now be described with reference to FIGS. 1A and 1B and with reference to the soil drilling machine where these kelly rods can be installed, which is shown in FIGS. 2A and 2B.

FIGS. 2A and 2B show, in particular, a drill string 20 comprising plurality of telescopic kelly rods 20A, 20B, 20C.

More specifically, FIG. 1A shows a first kelly rod 20A (outer kelly rod), which has the greatest diameter in the entire drill string 20 to which said kelly rod belongs. FIG. 1B, on the other hand, shows the last kelly rod 20C (inner kelly rod), which has the smallest diameter in the entire drill string 20 to which said kelly rod belongs.

According to FIGS. 2A and 2B, drill string 20 further comprises an intermediate kelly rod 20B, which can telescopically slide inside outer kelly rod 20A and in which, in turn, the intermediate kelly rod 20C can telescopically slide. In any case, the drill string can comprise any number of further intermediate kelly rods arranged inside one another.

Anyway, the number of kelly rods can range from a minimum of two (hence, the sole outer kelly rod 20A and inner kelly rod 20C, which, in this case, can slide relative to one another without the interposition of one or more intermediate kelly rods 20B) to a maximum number which depends on the diameter of the outer kelly rod 20A, but—in the prior art—usually is not greater than ten.

With reference to the mechanical locking kelly rod 20A of FIG. 1A, on the outer surface of the tubular body of the kelly rod there are longitudinal strips 21A, which extend over the entire length of the body. These strips 21A can be multiple and equally spaced apart from one another along the outer circumference of the kelly rod, in a number depending on the diameter of the kelly rod. Each strip 21A has, in the area of the top of the kelly rod, an engagement portion, for example an upper recess 22A, and has, in an intermediate portion of its length, a further engagement portion, for example an intermediate recess 23A. In any case, each strip can also have further engagement portions (for example recesses that are similar to the ones described above), which are obtained on it in different axial positions. Alternatively, each strip can also have one single engagement portion (such as a recess that is similar to the ones described above). Clearly, the engagement portions can also be located on the outer kelly rod 20A in positions that are different from the ones described and disclosed herein.

The aforesaid recesses 22A, 23A make up seats with a substantially rectangular shape where interlocking portions can be engaged, for example the strips (not shown) of the sleeve of rotary 10, thus remaining axially locked therein. By so doing, the strips of the sleeve of rotary 10 can transmit to kelly rod 20A both the torque, by means of a contact of the side of the strips of the sleeve with strips 21A, and the thrust, by means of a mechanical abutment striking between the base of the strips of the sleeve and the pushing surface in the lower part of recesses 22A. When the inner strips of the sleeve of rotary 10 are engaged in the seats created by recesses 22A of the outer kelly rod 20A, the latter is axially constrained to rotary 10. Through a rotation of the sleeve of the rotary in an opposite direction, on the other hand, the strips of the sleeve of rotary 10 can be disengaged from the seats created by recesses 22A of the outer kelly rod 20A, thus allowing kelly rod 22A to slide relative to the rotary.

At the upper end of the outer kelly rod 20A there is an upper abutment flange 24A, which has a greater diameter than the tubular body of the outer kelly rod 20A and acts as a limit stop, thus stopping the sliding of the outer kelly rod 20A relative to the sleeve in which the outer kelly rod 20A is inserted. For the transmission of torque and thrust between the outer kelly rod 20A and the intermediate kelly rod 20B, the principle basically is the same: at the lower end of the outer kelly rod 20A there is a sleeve 25A with interlocking portions, for example projections, in particular strips 26A facing inwards, which can be coupled to complementary engagement portions 22B, 23B of the intermediate kelly rod 20B. These strips 26A usually have a length that is much smaller than the one of the outer kelly rod 20A and, in particular, they have a length that is slightly smaller than the one of engagement portions, for example recesses where they can be engaged, and, therefore, they are adapted to be engaged in recesses of the second kelly rod 20B.

The intermediate kelly rod 20B and the inner kelly rod 20C making up drill string 20 all have a geometry that is substantially similar to the one of the outer kelly rod 20A and, therefore, these features will not be described in detail and reference is made to the description above. In particular, the intermediate kelly rod 20B and the inner kelly rod 20C also have outer longitudinal strips 21B, 21C, an upper abutment flange 24B, 24C, engagement portions (for example, an upper recess 22B and an intermediate recess 23B located on the intermediate kelly rod 20B and, respectively, an upper recess 22C and an intermediate recess 23C located on the inner kelly rod 20C), lower sleeves 25B, 25C provided with respective interlocking portions (for example, the inner strips 26B, 26C) complementary to the engagement portions.

Unlike the other kelly rods 20A, 20B of drill string 20, the inner kelly rod 20C (namely, the most internal one) is advantageously provided with a recovery flange 27C, which is constrained to the lower part of the body of the kelly rod. All the most external kelly rods 20A, 20B rest on the recovery flange 27C when they are in an unlocked condition, namely when they are axially unconstrained. At the top of the inner kelly rod there is an upper hooking terminal 28C for a kelly rod supporting and moving rope, which is connected, for example, through the interposition of a rotary joint. At the lower end of the inner kelly rod 20C there is a connection terminal, which allows a drilling tool 15 to be connected to the kelly rod 20C.

As already mentioned above, the known soil drilling machine 100 uses a drill string 20 of mechanical locking kelly rods described above.

Machine 100 is provided with a kinematic mechanism 2, preferably shaped like a parallelogram, for moving a mast 5 relative to a turret 3, which is mounted in a rotary manner on a self-moving carriage 4. Turret 3 comprises a control cabin for the operator. The operation of kinematic mechanism 2 allows mast to be moved both in order to adjust the drilling height relative to the center of the fifth wheel and in order to adjust the inclination relative to the ground level. These movements are also made possible by an articulated joint 6, such as a universal joint, interposed between mast 5 and kinematic mechanism 2. On mast 5 there is located a rotary 10, which is provided with a known pulling-pushing system 11. A telescopic drill string 20 is arranged through rotary 10 so as to receive torque and thrust from rotary 10.

Telescopic drill string 20 is guided, in the lower part, by the sleeve of rotary 10 and, preferably also in the upper part, by a rod-guiding head 13. A drilling tool 15, which can consist, for example, of a bucket or helical drill, is fixed to the lower end of the inner kelly rod 20C of drill string 20, so that it can receive torque and thrust from said inner kelly rod 20C.

Telescopic drill string 20 is moved by means of a winch 8, also known as main winch, which is supported by turret 3 of machine 100 and is configured to permit the winding or unwinding of a pulling element 9, for example a rope, which is fixed to winch 8 and, after having been turned on head 7 of the mast, is constrained to the most internal kelly rod of drill string 20. In particular, the connection between rope 9 and the inner kelly rod 20C takes place through the interposition of a known rotary joint 14. Rotary joint 14 fulfills the function of forbidding the transmission of torque between the inner kelly rod 20C and rope 9 of winch 8, thus preventing the rope from being dragged in rotation by the rotary motion of kelly rods 20A, 20B and 20C, hence allowing the rope not to twist.

FIG. 2A shows machine 100 in a condition in which it is in position in the drilling spot with drill string 20 in a completely retracted condition, namely with the minimum length and completely lifted relative to rotary 10. In this condition, the entire drill string 20 hangs on rope 9 and is axially unconstrained relative to rotary 10. In particular, the most internal inner kelly rod 20C is constrained to rope 9 and hangs from said rope, whereas the other kelly rods 20A, 20B rest, due to gravity, on the rod recovery flange 27C, which is located at the lower end of inner kelly rod 20C.

Rod recovery flange 27C is integral to the inner kelly rod 20C and has a diameter that is at least equal to the diameter of the outer kelly rod 20A, so that all remaining kelly rods 20A and 20B of drill string 20 rest on the flange, without being capable of sliding downward.

Said plurality of kelly rods 20A, 20B, 20C is divided into a plurality of kelly rods sliding adjacent to one another, in particular:

- a first pair of telescopic kelly rods, which can axially slide inside one another; in this case, said first pair consists of the outer kelly rod 20A and the second kelly rod 20B, and
- a second pair of telescopic kelly rods, which can axially slide inside one another; in this case, said second pair consists of the second kelly rod 20B and the third kelly rod 20C.

In the condition of FIG. 2A, each kelly rod 20A, 20B has its own interlocking portions, for example arranged on the respective lower sleeve 25A, 25B, which are coupled to the engagement portions of the kelly rod sliding next to it, hence the one arranged immediately on the inside, for example on the respective outer strips 21B, 21C.

Therefore, all kelly rods 20A, 20B, 20C are in a coupled condition and can transmit torque to one another. In order to start drilling, starting from the condition of FIG. 2A, drill string 20 is moved downward by unwinding rope 9 through the activation of winch 8. During this downward movement, drill string 20 axially slides inside the sleeve of rotary 10, until drilling tool 15 rests on the ground.

At this point, by operating the motors of rotary 10, a rotation can be applied to drill string 20 with a desired rotation speed and a desired torque, in a predetermined drilling direction, so that drilling tool 15 starts drilling the soil moving downward thanks to the weight of kelly rods 20A, 20B, 20C weighing upon it, which can slide relative to rotary 10. In case a further thrust needs to be applied to the drilling tool, the operator can have rotary 10 to slide along mast 5, so that rotary 10 also slides relative to drill string 20, which will rest on the bottom of the drilling site, until rotary 10 reaches a recess 23A in an intermediate position of the outer kelly rod 20A.

In this situation, by applying a rotation to the sleeve of rotary 10 in the drilling direction, the interlocking portions of the sleeve of rotary 10 engage intermediate recess 23A of the outer kelly rod.

Subsequently, by moving rotary 10 downward by means of pulling-pushing system 11, the strips of the sleeve of rotary 10 strike against the corresponding pushing surface of recess 23A of the outer kelly rod 20A. By so doing, a thrust is transmitted from rotary 10 to kelly rods 20A, 20B, 20C and to drilling tool 15 and, in this condition, drill string 20 slides downward in an integral manner with the sliding movement of rotary 10.

The aforesaid coupling of the interlocking portions or strips of the sleeve of rotary 10 to the engagement portions or recesses 23A of the outer kelly rod 20A is fairly simple to be obtained by the operator, as at least recesses 23A of the outer kelly rod are exposed and are visible from the controlling position.

When the movement of rotary 10 has caused drill string 20 to move forward to an extent that is sufficient to fill drilling tool 15, the sleeve of rotary 10 needs to be rotated in an opposite direction relative to the drilling direction, keeping tool 15 resting on the ground of the drilling site. In this way, the sleeve of rotary 10 is caused rotate relative to kelly rods 20A, 20B, 20C and the strips of the sleeve disengage recess 23A of the outer kelly rod 20A. Besides axially unconstraining kelly rods 20A, 20B, 20C relative to rotary 10, at the same time, kelly rods 20A, 20B, 20C are brought to a decoupled condition relative to one another, in which they are axially unconstrained from one another and are not capable of transmitting a thrust downward to drilling tool 15.

When winch 8 is subsequently activated, rope 9 is rewound so as to cause the kelly rods to be lifted, dragged by rod recovery flange 27C of the inner kelly rod, until tool 15 gets out of the drilling site, thus allowing the soil enclosed in the tool to be discharged.

Once tool 15 has been discharged, it is moved again to the bottom of the drilling site and the operations described above are repeated in order to apply a new thrust to the tool. When rotary 10 reaches the lower limit stop position along mast 5, no thrust can be applied any longer to drill string 20 by pressing intermediate recess 23A. Therefore, the operator will have to disengage the strips of the sleeve of rotary 10 from the intermediate recess 23A of the outer kelly rod 20A and have rotary 10 slide upward. At the same time, kelly rods 20A, 20B, 20C remain still, resting on the bottom of the drilling site, until rotary 10 reaches the upper recess 22A of the outer kelly rod 20A. In this condition, the upper flange 24A of the outer kelly rod 20A, which has a larger diameter than the kelly rod, strikes against a suitable abutment portion of rotary 10.

By applying a rotation of the sleeve of rotary 10 in the drilling direction, the strips of the sleeve of rotary 10 engage the upper recess 22A of the outer kelly rod. At this point, by moving rotary 10 downward by means of pulling-pushing system 11, the strips of the sleeve of rotary 10 strike against the corresponding pushing surface of recess 22A of the outer kelly rod 20A. By so doing, a thrust is transmitted from rotary 10 to kelly rods 20A, 20B, 20C and, in this condition, drill string 20 slides downward in an integral manner with the sliding movement of rotary 10.

Then, all the tool drilling and discharging operations described above can be repeated.

Moving on with the drilling procedure, when the depth reached is greater than the length of the outer kelly rod 20A, the condition shown in FIG. 2B occurs.

In particular, in FIG. 2B, the outer kelly rod 20A is in the lowest position relative to rotary 10, as the outer kelly rod 20A has crossed rotary 10, reaching the lower limit stop position, which means that the upper flange 24A of the outer kelly rod 20A strikes against the abutment surface of rotary 10. Hence, the outer kelly rod 20A does not hang any longer from rope 9, but now all its weight is directly borne by rotary 10, which means that it is supported by pulling-pushing system 11 of rotary 10. Therefore, in this case, drill string 20 is only partly supported (outer kelly rod 20*a*) by rotary 10.

The inner strips of the sleeve of rotary 10 are then in the area of the upper recesses 22A of the outer kelly rod 20A and they keep this position as long as the outer kelly rod 20A is completely lowered. Hence, the outer kelly rod 20A has reached the completely lowered position relative to rotary 10. In this situation, the strips of all kelly rods 20A, 20B, 20C are disengaged from the respective recesses by means of rotation of the sleeve of rotary 10 in a direction that is opposite to the drilling direction. Furthermore, if rope 9 is further unwound from winch 8, the outer kelly rod 20A remains still relative to rotary 10, as it is supported by rotary 10 itself. On the other hand, if rope 9 is unwound, the intermediate kelly rod 20B and the inner kelly rod 20C keep moving downward sliding relative to rotary 10 and relative to the outer kelly rod 20A. The intermediate kelly rod 20B and the inner kelly rod 20C are supported by recovery flange 27C, which, in turn, is supported by rope 9, as it is arranged on the inner kelly rod 20C.

According to FIG. 1B, when tool 15 reaches the bottom of the drilling site, it can happen that the intermediate kelly rod 20B partially slides out of the outer kelly rod 20A. In this situation, the lower sleeve 25A and its inner strips 26A are in an intermediate position between the upper recess 22B and an intermediate recess 23B. In this situation, if the operator of the machine wants to apply a thrust to tool 15, he/she needs to make rotary 10 and the outer kelly rod 20A integral thereto slide until they reach one of the two possible mechanical locking positions, in which the lower sleeve 25A and its inner strips 26A of the outer kelly rod 20A are aligned in the area either of the intermediate recess 23B or of the upper recess 22B (not shown) of the second kelly rod 20B.

Once one of these mechanical locking positions is reached, by applying a rotation in the drilling direction to the sleeve of rotary 10, the strips of the sleeve of the rotary engage the upper recess 22A of the outer kelly rod 20A and, simultaneously, the inner strips 26A of the outer kelly rod 20A engage one of recesses 22B or 23B of the intermediate kelly rod 20B. In this condition, a downward thrust of rotary 10 is transmitted both to the outer kelly rod 20A and to the intermediate kelly rod 20B by means of the interlocking of the strips in the respective recesses, then the second kelly rod 20B, by resting on the rod recovery flange 27C of the inner kelly rod 20C can transmit the thrust to the inner kelly rod 20C and to tool 15.

However, this type of soil drilling machine is affected by some drawbacks.

With reference, again, to the drilling condition shown in FIG. 2B, the moving maneuver of rotary 10 and of the outer kelly rod 20A integral thereto, until the lower sleeve 25A and its inner strips 26A of the outer kelly rod 20A are aligned in the area either of the intermediate recess 23B or of the upper recess 22B (not shown in the figure) of the second kelly rod 20B, is fairly complicated for the operator of machine 100.

The complexity of the maneuver is mainly due to the fact that both sleeve 25A and recesses 23B and 22B are not visible to the operator sitting in the cabin, as they are inside the drilling site. In order to make this maneuver, expert operators, at first, apply to drill string 20 a small torque in the drilling direction, which is much smaller than the maximum one that can be generated by the rotary and is sufficient to cause inner strips 26A of sleeve 25A to strike against the longitudinal outer strips 21B of the intermediate kelly rod 20B. After that, the operator, always keeping a small torque applied, operates pulling-pushing system 11, causing rotary 10 and outer kelly rod 20A to slide upward or downward, so that inner strips 26A of the outer kelly rod get close either to upper recess 22B or to intermediate recess 23B of intermediate kelly rod 20B. Inner strips 26A, which, at first, rest with their entire length on outer strips 21B, by sliding will end up having only part of their length in contact with strips 21B, as the remaining part overlaps a recess 22B or 23B. This contact part gets smaller and smeller, increasing the specific pressure in said contact part of the inner strip. If the applied torque is small, this pressure remains within limits allowed by the material of the strips and does not cause damages. When the sliding of outer kelly rod 20A is sufficient to cause strips 26A to completely face one of the recesses of the second kelly rod, these strips get into the recesses and are coupled to them. An expert operator is capable of perceiving when the inner strips get into the recesses, usually because of the rotation, the vibrations or the noise generated by them. Once he/she has perceived the engagement of the strips in the recesses, the operator goes on applying a greater torque to the kelly rods and also applying a thrust to the kelly rods. All the maneuvers described above must be repeated once the depth of the drilling exceeds the length of the first two kelly rods 20A and 20B and, hence, the first two kelly rods are moved in an integral manner with rotary 10 in order to try and find the interlocking positions on the following kelly rod 20C.

Therefore, a drawback of this technology lies in the fact that the detection of the correct mutual interlocking of the strips and the correctness of the sequence of maneuvers necessary for this interlocking only depend on the experience of the operator. A scarcely expert operator, starting from the condition of FIG. 2B, could choose to apply, from the very beginning, the maximum torque of the rotary while he/she makes both rotary 10 and outer kelly rod 20A slide in the search for a correspondence with the recesses of the second kelly rod 20B. As already mentioned above, during this maneuver the inner strips end up in a partial contact condition and, if the applied torque is too high, specific contact pressures can exceed the admissible limits, thus generating plastic deformations of the strips and wear of the corners of the recesses, which are so rounded, causing an excessive wear of the kelly rods and leading to a loss of efficiency of the locking system, which can make the mutual interlocking of the kelly rods impossible or not very safe. Furthermore, the problem of having to correctly aligning the kelly rods, so that the strips end up in the area of the recesses, can arise again with every tool loading and discharging cycle. As a matter of fact, assuming to start from a condition in which the inner strips of a kelly rod are coupled to the intermediate recesses of the following kelly rod, once tool 15 has been pushed until it has reached its filling, the tool has to be removed from the drilling site by winding rope 9 on winch 8, moving the entire drill string back to the minimum length contracted condition, in order to then empty the tool on the outside of the drilling site and subsequently lower again the tool up to the bottom of the drilling site by unwinding rope and extending the kelly rods. If, during the tool lifting, discharging and lowering phases, the operator has never had rotary 10 slid relative to mast 6, then the kelly rods are still correctly aligned so as to allow the inner strips and the intermediate pockets to be interlocked. If, on the other hand, the operator has moved rotary 10, leaving it in a position different from the one it had at the end of the previous drilling cycle, there is a misalignment between all the kelly rods that have completely slid out, which will be moved in an integral manner with rotary 10 relative to the bottom of the drilling site, and the kelly rods that have partially slid out, which will rest again on the bottom of the drilling site keeping the previous position. This misalignment means that the kelly rods are not any longer in the correct mutual axial condition permitting their interlocking and, therefore, the operator has to try and find, again, the position of the recesses that enables the insertion of the inner strips.

It is evident that these maneuvers require downtimes, which reduce the productivity of the drilling process. The search for the correct position of the kelly rods relative to the recesses becomes particularly complicated when pulling-pushing system 11 is of the type having a winch, as, in this solution, it is not possible to use fixed reference positions of rotary 10, which, in case of a pulling-pushing system with a cylinder, could be the top and bottom limit stop positions of the moving cylinder of rotary 10.

SUMMARY OF THE INVENTION

In particular, an object of the invention is to relieve the operator of the load of all those complicated and dangerous maneuvers described above with reference to the prior art, by means of a system that gives the operator precise indications on the correct mutual position of the kelly rods during the strip interlocking phases to be carried out when dealing with mechanical locking kelly rods, thus obtaining a use simplification and a greater productivity of the drilling machine, which increase the amount of time elapsing from one maintenance to the following one.

Then, there is advantageously the possibility of signaling, for example by showing it to the operator, the mutual position of the strips and of the recesses of the kelly rods that must be mechanically locked. This makes the work of the operator much easier, as he/she can mechanically lock the kelly rods more quickly and with a greater precision, thus increasing the productivity of the drilling process and reducing the wear of the kelly rods and of the machine.

DETAILED DESCRIPTION OF THE INVENTION

Figure 1A:
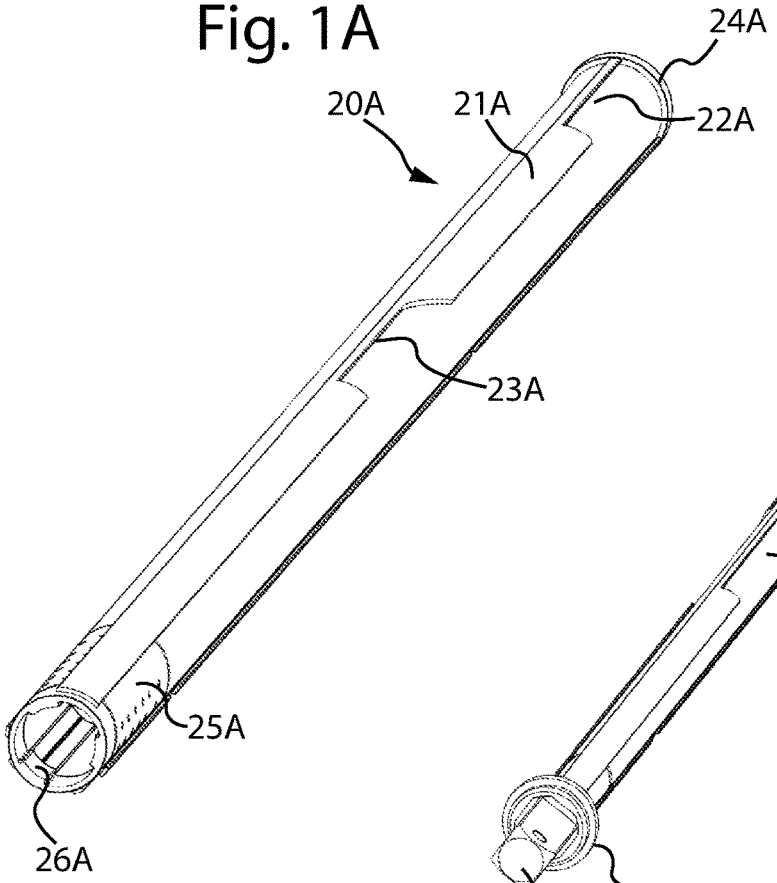
FIG. 1A is a perspective view of an outer kelly rod according to the prior art and belonging to a drill string of a soil drilling machine.
Figure 1B:
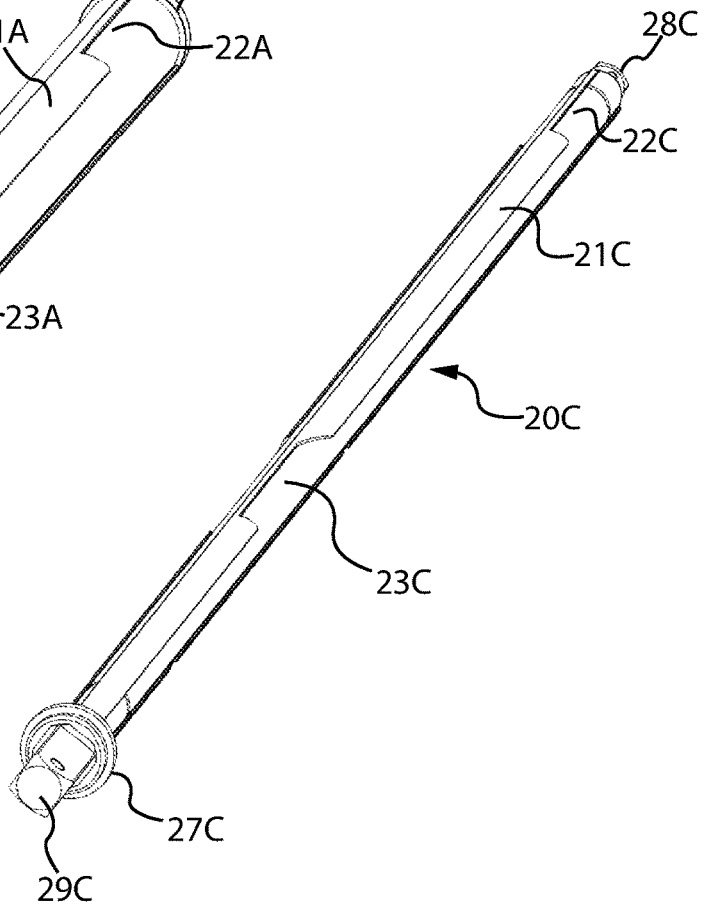
FIG. 1B is a perspective view of an inner kelly rod according to the prior art and belonging to a drill string of a soil drilling machine.
Figure 2A:
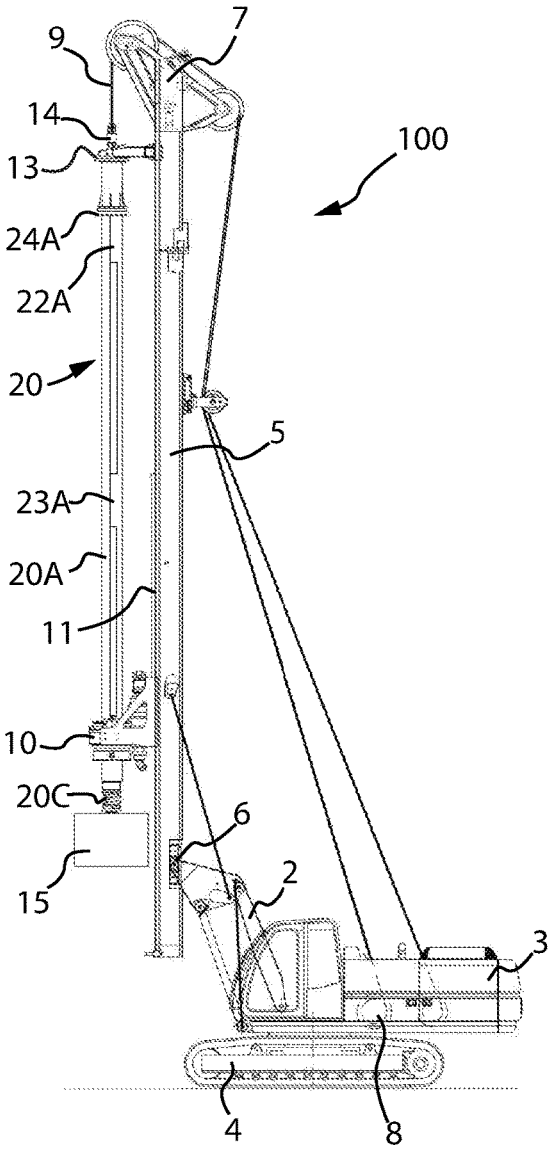
FIG. 2A is a side elevation view of a soil drilling machine according to the prior art and comprising a drill string including the kelly rods shown in FIG. 1A and in FIG. 1B.
Figure 2B:
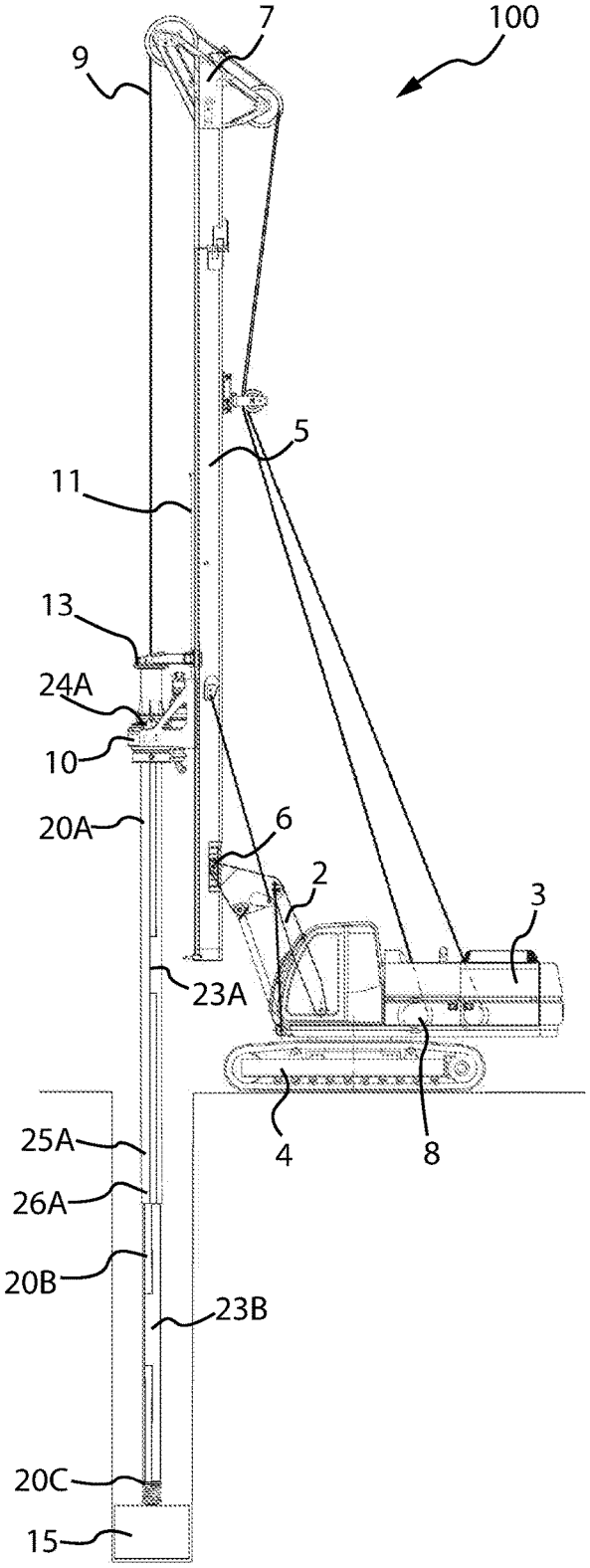
FIG. 2B is a view similar to the one of FIG. 2A, wherein the machine is shown in a different operating condition.
Figure 3A:
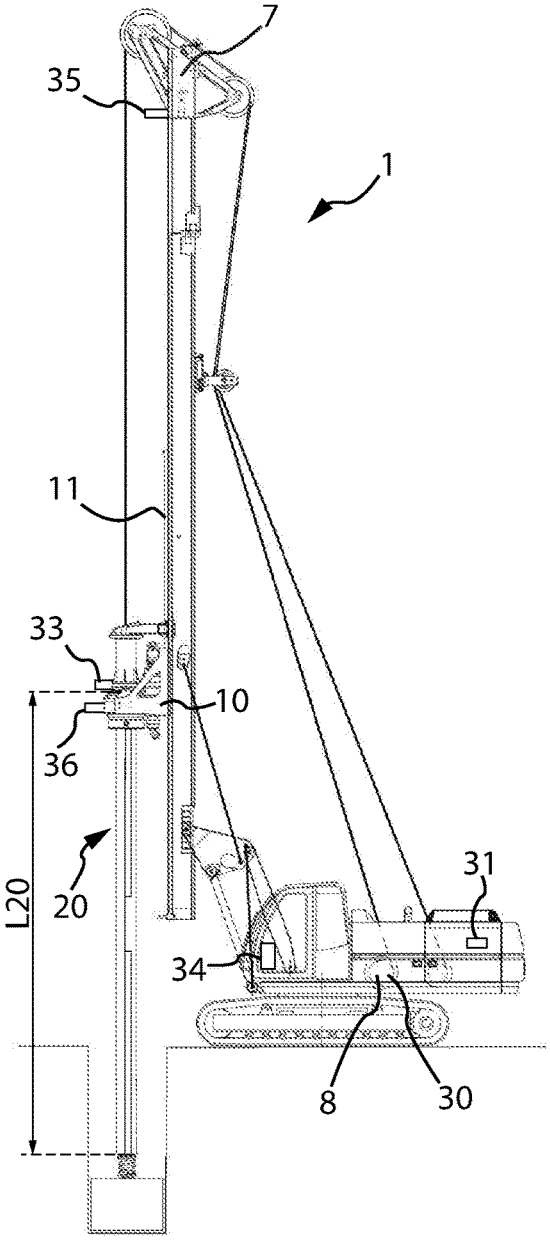
FIG. 3A is a side elevation view of a soil drilling machine provided with a system for detecting a plurality of mechanical locking positions of a drill string, wherein the system is structured according to an explanatory embodiment of the invention.
Figure 3B:
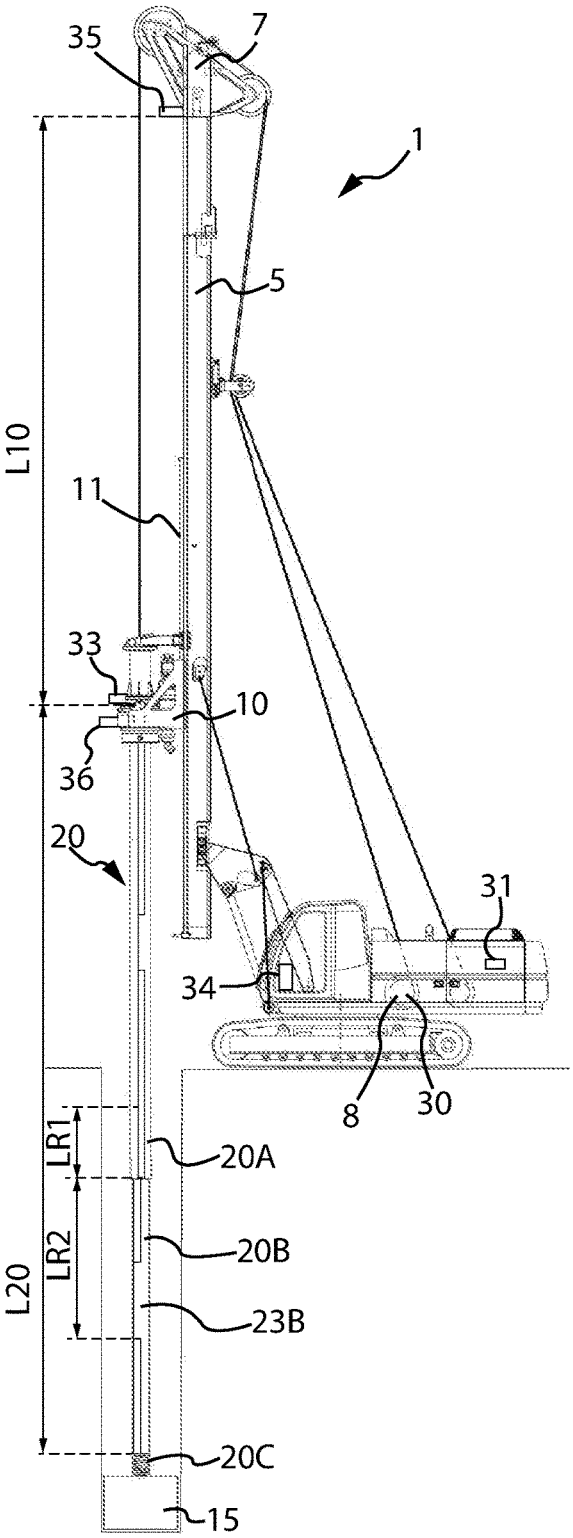
FIG. 3B is a view similar to the one of FIG. 3A, wherein the machine is shown in a different operating condition.

With reference to FIGS. 3A and 3B, number 1 indicates, as a whole, a soil drilling machine.

Details and elements that are similar to—or fulfill a similar function as—the ones of the known drilling machine, which is indicated with number 100 and was previously described with reference to FIGS. 1A, 1B, 2A and 2B, are associated with the same alphanumeric references. Therefore, for the sake of brevity, for machine 1 according to the invention reference is made to the description above concerning prior art machine 100, which is considered as part of the following detailed description.

Unlike machine 100 described above, machine 1 according to the invention is provided with a system for detecting at least one mechanical locking position of drill string 20, said system being manufactured according to an explanatory embodiment of the invention.

Figure 4:
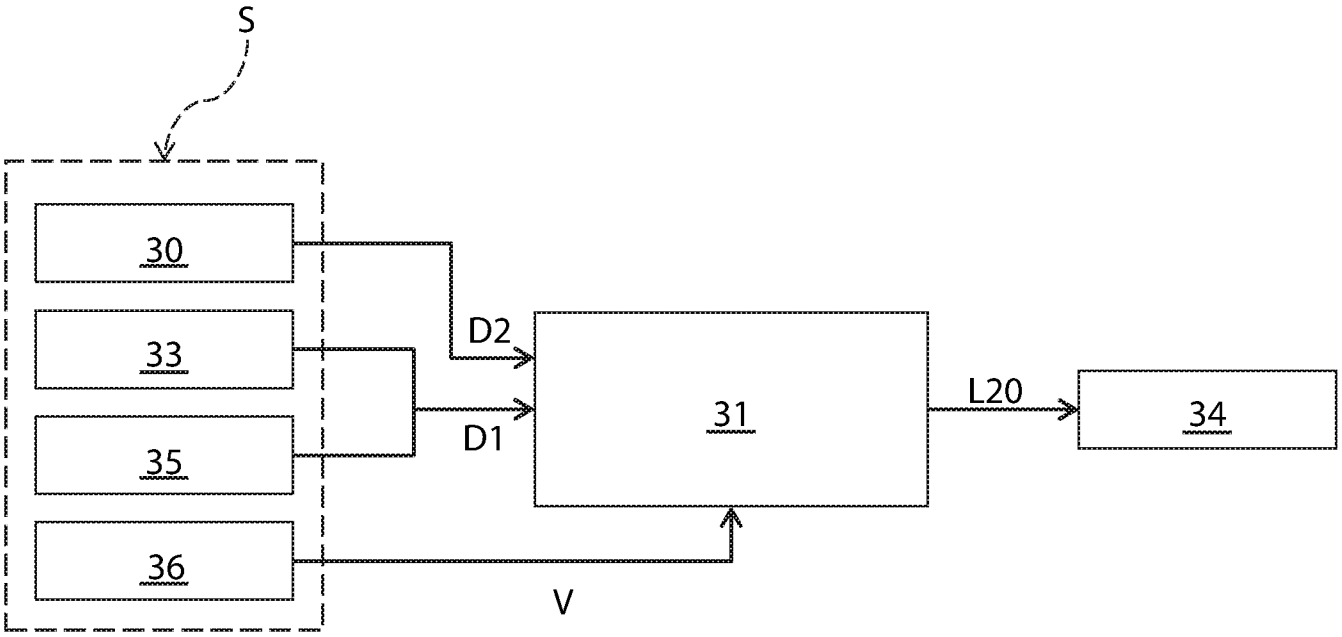
FIG. 4 is a schematic representation through block diagrams of a system for detecting a plurality of mechanical locking positions of a drill string in a soil drilling machine, wherein such system is structured according to an explanatory embodiment of the invention.

With reference in particular to FIG. 4, the system comprises a sensor apparatus S, which is configured to detect and provide:

- first data D1 indicating the position assumed by the top of drill string 20, in particular by the top of inner kelly rod 20A, and
- second data D2 indicating the position assumed by the bottom of drill string 20, in particular by the bottom of inner kelly rod 20C to which drilling toll 15 is to be fixed.

The system further comprises a control unit 31, which is configured to calculate an estimated length L20 of drill string 20 based on the first data D1 and the second data D2 detected by sensor apparatus S. In the embodiment shown, control unit 31 is configured to calculate the distance between the top of drill string 20 and the bottom of the drill string.

Furthermore, control unit 31 is configured to compare estimated length L20 with one or more reference length values. In particular, each one of the reference length values corresponds to a length assumed by drill string 20, in which a respective pair of the kelly rods (namely, in the embodiment shown, the first pair 20A, 20B or the second pair 20B, 20C) is in a mechanical locking position (in which the engagement portion—e.g. the recesses—of the kelly rod of the aforesaid pair of kelly rods having the smallest diameter and the interlocking portion—e.g. the strings—of the kelly rod of the aforesaid pair of kelly rods having the largest diameter can be moved from the decoupled condition to the coupled condition).

Furthermore, the system comprises a signaling apparatus 34, which is configured to signal when estimated length L20 corresponds to a reference length value.

In this way, given the signal provided by signaling apparatus 34, an operator controlling machine 1 is aware of the fact that a pair of kelly rods (namely, in the embodiment shown, the first pair 20A, 20B or the second pair 20B, 20C) is in the respective mechanical locking position. In the way, the operator is capable of moving the kelly rods from the decoupled condition to the coupled condition, causing rotary 10 to make a rotation in the drilling direction.

Preferably, sensor apparatus S comprises a first sensor 35, which is configured to detect a first information representing the position assumed by rotary 10 along mast 5. Furthermore, the sensor apparatus comprises a second sensor 33, which is configured to detect a second information representing the fact that drill string 20 is at least partly supported by rotary 10. Operatively, when the second sensor 33 detects that drill string is at least partly supported by rotary 10, control unit 31 uses the first information representing the position assumed by rotary 10 along mast 5 as data D1 indicating the position assumed by the top of drill string 20. Indeed, in this case, the position of rotary 10 is substantially comparable with the position assumed by the top of drill string 20, namely by the top of outer kelly rod 20A.

Preferably, the first sensor 35 is configured to detect the axial position of rotary 10 along mast 5, in particular relative to an end of mast 5 or of head 7.

For example, the first sensor 35 is a laser distance measurer. Preferably, the laser distance measurer is installed in a fixed position at an end of mast 5 or on head 7. In case a laser sensor is used, it is preferably installed at a height above the upper limit stop position of rotary 10 along mast 5 or at a height below the lower limit stop position of rotary 10 along mast 5.

In the embodiment shown in FIGS. 3A and 3B, the first sensor 35 is installed on head 7 and is oriented so as to emit a laser beam directed towards the body of rotary 10 and, in particular, to a proper target surface present on rotary 10, which, for example, can be a reflecting surface. In this way, the first sensor 35 can measure all the translation movements of rotary 10 relative to a zero reference height, which can be set during the calibration and the zero setting of the sensor. For example, the zero height can be referred to the upper end of mast 5, as shown in FIGS. 3A and 3B, but, in an equivalent manner, it can relate to the lower end of mast 5 or to one of the limit stop positions of rotary 10 along mast 5. Anyway, different constructive variants are possible, which use different types of first sensor 35 to measure the position of rotary 10. For example, the first sensor 35 can be a wire sensor, in which the end of the wire is connected to the body of the rotary so that the wire is wound and unwound from the sensor based on the movement of the rotary.

In further embodiments, in case of a machine 1 with a pulling-pushing system 11 having a hydraulic cylinder, the first sensor 35 can be a sensor of the stroke of the rod of the cylinder, which moves rotary 10.

In further embodiments, in case of a machine 1 with a winch pulling-pushing system 11, the first sensor 35 can be an encoder installed on the winch of pulling-pushing system 11, which measures the rotations of the winch in order to determine the movements of rotary 10.

However, the use of a first laser sensor 35 is anyway preferable because it ensures a greater precision and can be used in the same manner both in cylinder pulling-pushing machines and in winch pulling-pushing machines.

As already mentioned above, the values measured by the first sensor 35 are then processed by control unit 31 in order to calculate the position of rotary 10 along mast 5.

Preferably, the second sensor 33 is configured to detect when outer kelly rod 20A of the drill string is in the lower limit stop position relative to rotary 10. As already mentioned above, this condition corresponds to the fact that drill string 20 rests on or is at least partly supported by rotary 10.

In the embodiment shown, the limit stop position corresponds to the situation in which outer kelly rod 20A has completely crossed rotary 10, causing its upper flange 24A to strike against the abutment surface of said rotary 10. In the example shown, hence, the second sensor 33 fulfills the function of detecting the lower limit stop of the outer kelly rod 20A.

Preferably, the second sensor 33 is a proximity sensor installed on the casing of rotary 10, in particular close to the passage for drill string 20. When the outer kelly rod 20A of the drill string is completely lowered relative to rotary 10, for example like in FIGS. 3A and 3B, upper flange 24A ends up in front of the second sensor 33.

In a variant of the invention, upper flange 24A is advantageously made of a metal material and the second sensor 33 is capable of detecting the presence of the flange and of sending a signal to control unit or CPU 31 of machine 1. In other constructive variants, the second sensor 33 could consists, for example, of a micro-switch, which is operated by the passage of flange 24A when it reaches the striking position against the abutment surface of rotary 10, when outer kelly rod 20A has reached the lower limit stop.

Let's consider a drilling configuration with drill string 20 completely closed, namely in a minimum length configuration, and with drill string 20 in an intermediate position relative to rotary 10, namely in a position different from the lower limit stop of drill string 20. In this drilling configuration, control unit 31 of machine 1 is capable of recognizing that drill string 20 is completely closed thanks to the fact that the second sensor 33 does not detect the limit stop position. Indeed, in the embodiment shown, the second telescopic kelly rod 20B and the following ones can start telescopically sliding out only when the outer kelly rod 20A rests with its upper flange 24A on the rotary. In this way, the outer telescopic kelly rod 20A does not hang any longer from the rope and rests on the recovery flange 27C.

When outer kelly rod 20A reaches the lower limit stop condition with drill string 20 completely closed, also visible in FIG. 3A, control unit 31 recognizes that estimated length L20 is equal to the minimum value and gets ready to measure the following variations of length L20. In this condition, the value of the quantity of rope unwound from the winch, which is measured by sensor apparatus S (in particular, by winding sensor 30 which will be described hereinafter), can be set as equal to zero.

In the embodiment shown, estimated length L20 referred to the drill string can be interpreted, for example, as the distance between upper flange 24A of outer kelly rod 20A and rod recovery flange 27C arranged at the lower end of inner kelly rod 20C.

In the embodiment shown, as already mentioned above, winding sensor 30 is configured to measure the quantity of flexible pulling member, such as rope 9, unwound from winch 8.

Preferably, winding sensor 30 is an encoder mounted on winch 8 and capable of measuring the rotations of the drum of winch 8. Control unit 31, based on the signal of winding sensor 30 and based on the awareness of the characteristic sizes of the drum of winch 8 and of rope 9, is configured to calculate the quantity of rope unwound from the winch.

In a constructive variant, winding sensor 30 could be an encoder mounted on one of the pulleys of head 7 or it could be an optical sensor installed on a fixed structure close to rope 9 and capable of detecting the linear sliding of the rope.

In the embodiment shown, control unit 31 comprises a memory unit where all the geometric data concerning all drill strings 20 that can be installed in machine 1 are pre-loaded. Said rill strings 20 can vary in terms of length of kelly rods 20A, 20B, 20C, number of the kelly rods making up drill string 20 and diameter of the kelly rods. By way of non-limiting example, upon starting of machine 1, or—if necessary—upon installation of machine 1, the operator must select, preferably from a list displayed on a display available in the cabin, telescopic drill string 20 installed in machine 1. When the selection is made by the operator, control unit 31 loads all the data concerning that drill string 20, for example the minimum length of the drill string in a completely contracted configuration and the maximum length of the drill string in a completely extended configuration, the length of each single kelly rod, the position of the recesses on each single kelly rod of the drill string, etc.

Since rope 9 is directly connected to the upper end of inner kelly rod 20C and since the length of inner kelly rod 20C is known to control unit 31, the measure of the quantity of rope unwound from the winch gives an indication of the position of drilling tool 15. Based on the initial zero setting position of the position of drilling tool 15 to be used, the measure carried out by sensor 30 can indicate the position of tool 15 relative, for example, to the ground level or relative to rotary 10 or relative to any reference surface.

In order for the value measured by winding sensor 30 to always be precise and reliable, it is preferable that the rope always is pulled, as a loosening thereof could alter the detections. Indeed, when drilling tool 15 reaches a resting surface stopping its downward movement, if winch 8 continued unwinding rope 9, winding sensor 30 would continue measuring an unwinding, but this unwinding of rope 9 would not correspond to a translation of drilling tool 15.

In order to avoid the aforesaid problem of the loosening of rope 9, machine 1 is provided with a known pulling device 32, which is configured to keep rope 9 pulled. For example, this pulling device 32 can act through a manual control element in the cabin, properly controlling the motor associated with winch 8, and—if necessary—there can also be a loosening detection device (not shown) associated with rope 9 so as to always keep said rope 9 pulled.

Preferably, signaling apparatus 34 is a display configured to visually represent the reaching and/or the approaching of estimated length 20 to one of the reference length values.

Preferred and optional details of the system according to an embodiment of the invention will be described hereinafter.

Control unit 31, based on the values detected by sensors 30, 33, 35 and based on the geometric data of drill string 20 pre-loaded in the memory of control unit 31 itself, is capable of calculating, in every drilling phase of machine 1, actual length L20 of drill string 20. Indeed, as soon as machine 1 reaches the configuration shown in FIG. 3A, in which drill string 20 is completely retracted and, by sliding downward, has just struck against rotary 10 by means of upper flange 24A, control unit 31 recognizes that drill string 20 has an estimated length L20 with a minimum value. Starting from this minimum value, control unit starts calculating the variations of length L20 due to the operation of winch 8 or due to the operation of the pulling-pushing system moving rotary 10. Then, as the drilling goes on in order to reach, for example, the drilling condition shown in FIG. 3B, control unit 31 updates estimated length L20, adding or subtracting a length equal to the quantity of rope 9 unwound from or wound on winch 8 as measured by winding sensor 30. In the same way, control unit 31 adds to or subtracts from estimated length L20 a length equal to the translation made by rotary 10 and measured by the first sensor 35.

Control unit 31 keeps calculating the actual length of drill string 20 as long as detection sensor 33 detecting the lower limit stop of outer kelly rod 20A keeps detecting that upper flange 24A rests on the abutment surface of rotary 10. When the flange 24A lifts relative to rotary 10 and is not detected any longer by sensor 33, this means that drill string 20 is in a completely retracted condition, thus having a known length L20, and, in these conditions, the operator is capable of visually checking, from his/her control position in the cabin, where the recesses of the outer kelly rod 20A are located.

Since, as already mentioned above, in drill string 20 kelly rods 20A, 20B, 20C slide out and withdraw according to a precise sequence established by mechanical abutments, by knowing estimated length L20 in a given instant it is possible to determine the mutual position of all kelly rods 20A, 20B, 20C of drill string 20. The forced sequence of sliding out and return of kelly rods 20A, 20B, 20C further makes sure that each mutual mechanical locking position of the kelly rods, namely each position in which the inner strips of each kelly rod are suited to be coupled to a recess of the kelly rode arranged immediately on the inside, corresponds to a precise length L20 of the drill string.

By storing in control unit 31 all the reference length values at which there can be a correct mechanical locking of kelly rods 20A, 20B, 20C, control unit 31 is capable of comparing, in each instant, the actual length L20 with the table of the reference length values corresponding to the mechanical locking positions. Hence, control unit 31 can control the signaling to the operator of the reaching of a mechanical locking position, adapted to carry out the passage from the decoupled condition to the coupled condition, and/or control unit 31 can give indications for the reaching of said mechanical locking position.

With reference to FIG. 3B, intermediate kelly rod 20B is in an intermediate position between two possible mechanical locking positions between outer kelly rod 20A and intermediate kelly rod 20B. In the same way, estimated length L20 of drill string 20 has an intermediate value between two reference length values corresponding to two consecutive possible mechanical locking positions. In other words, inner strips 26A of outer kelly rod 20A are in an intermediate position between two contiguous recesses 23B and 22B (not visible) of the second kelly rod 20B. Therefore, in order to reach a possible locking condition, it is necessary to reduce estimated length L20 by a distance LR2 or to increase estimated length L20 by a distance LR1.

In particular, distance LR2 equals the distance of inner strips 26A from the first reachable recess 23B arranged at a lower height than strips 26A, whereas distance LR1 equals the distance of inner strips 26A from the first reachable recess 23B arranged at a higher height than strips 26A.

Preferably, control unit 31, based on the values measured by sensor apparatus S, is capable of calculating distances LR1 and LR2 and of showing them to the operator by displaying them on display 34 in the cabin. The operator, who wants to obtain a mechanical locking of kelly rods 20A, 20B, 20C, can operate pulling-pushing system 11 so as to cause rotary 10 to slide on mast 5 by a quantity equal to distance LR1 or LR2. The operator preferably chooses to make the smallest movement between LR1 and LR2 in order to accelerate the maneuver. During this translation, values of LR1 and LR2 are updated in real time.

In an embodiment of this invention, control unit 31 can also check whether, starting from the current position, the pulling-pushing system has a travel that is sufficient to permit both movements or whether one of the two movements is impossible, for example because rotary 10 is already too close to one of the two limit stop positions on mast 5. In case one of the two movements cannot be made, control unit 31 signals to the operator that the corresponding mechanical locking position cannot be reached. In a further variant, display 34 can show, in a graphic manner, the current position of the inner strips relative to the position of the two most adjacent recesses, thus updating the information displayed when the kelly rods are subjected to relative translations.

In a simplified constructive solution, control unit 31 could not indicate the two heights LR1 or LR2 to the operator on display 34, but it could operate a sound or light warning device when the value of length L20 of drill string 20 corresponds to mechanical locking position in which it is possible to shift from the decoupled position to the coupled condition.

Preferably, sensor apparatus S further comprises a vibration sensor 36, which is configured to detect vibration data V representing the vibrations propagated through said drill string 20. Control unit 31 is configured to correct the estimated length L20 determining that a respective pair of kelly rods (namely, the first pair 20A, 20B or the second pair 20B, 20C) as reached a maximum mutual distance position, based on estimated length L20 and when vibration data V exceed a threshold value.

In a constructive variant, in order to increase the precision of the detecting system in terms of mutual position of the kelly rods 20A, 20B, 20C, it is possible to install the vibration sensor 36, in particular, on the frame of the rotary 10.

In those applications in which great-depth drilling operations must be carried out, the use of drill strings 20 consisting of a large number of kelly rods 20A, 20B, 20C can lead to a condition in which, when drilling tool 15 is close to the bottom of the drilling site, the length of the free segment of rope 9 extending from the pulleys of head 7 up to upper end of the inner kelly rod 20C is more than a hundred meters long. In this situation, if the weight of one or more kelly rods 20A, 20B, 20C and, if necessary, of the material collected by drilling tool 15 weighs on rope 9, there can be elastic elongations of rope 9 to an extent that cannot be neglected. These elongations cannot be detected by winding sensor 30, for example because they do not cause additional rotations of winch that can be detected by an encoder. The elongation of the suspended rope segment causes at least inner kelly rod 20C and, if necessary, all the other kelly rods resting on the rod recovery flange to be subjected to a relative sliding movement with respect to the kelly rods that are completely extended and are suspended from and supported by rotary 10. As already mentioned above, this relative sliding is not detected by winding sensor 31 cooperating with control unit 31. Since the axial clearance present between the inner strips and the recesses, namely the difference between the length of the inner strips and the length of the recesses, can range from a few centimeters to some decimeters, a non-detected relative sliding that is equal to or greater than these clearances could cause errors in the calculation of the correct mechanical locking positions of kelly rods 20A, 20B, 20C.

With every filling cycle of drilling tool 15, when kelly rods 20A, 20B, 20C of drill string 20 telescopically slide out to reach the bottom of a drilling site created during the previous drilling cycles, the operator maintains a very high downward speed of kelly rod 20A, 20B, 20C through a quick unwinding of rope 9, so as to reduce the working times of the cycle. During the downward movement, when one of kelly rods 20B, 20C reaches its lower limit stop position, there is a collision between said kelly rod 20B, 20C and the preceding kelly rod sliding adjacent thereto (in this case 20A, 20B), in the area of the upper flange 24B, 24C of said kelly rod and the inner strips of the preceding kelly rod, which causes the kelly rod to stop. Given the high speeds and the significant weight of the kelly rods, the extent of the collision taking place every time a kelly rod reaches the lower limit stop is remarkable and is transmitted to all the kelly rods arranged at a higher height than the kelly rod subjected to the striking, thus reaching the body of rotary 10 from which the outer kelly rod 20A hangs. This collision generates a vibration peak which can easily be recognized as it has a greater intensity than the background vibrations generated during drilling operations. This peak can be detected by vibration sensor 36, preferably an accelerometer, installed on the body of rotary 10. Vibration sensor 36 can then send a signal to control unit 31, when it detects that there is a collision generated by the limit stop of a kelly rod.

Since, as already mentioned above, the kelly rods of drill string 20 slide out with a set sequence, from the one arranged more on the outside (20A) to the one arranged more on the inside (20C), it is possible to identify, starting from a condition with a completely retracted drill string 20, every time sensor 36 detects a collision during the downward movement of the kelly rods, which and how many kelly rods have reached the limit stop position. In the moment in which sensor 36 detects the collision of a kelly rod, it is possible to increase by one the number of kelly rods that have completely slid out, whereas the remaining ones are completely contracted. Since the length of the completely contracted drill string 20 is known and stored in control unit 31 and since, in the same way, the length an the travel of each kelly rod of the drill string are known and stored in control unit 31, every time vibration sensor 36 detects the collision, due to the limit stop of a kelly rod, it is possible to determine with precision length L20 of the drill string. By using sensor 36, operators can obtain an exact value of length L20 only when the following kelly rod reaches the limit stop generating a new collision and a new vibration peak.

In this way, then, vibration sensor 36 can be used by control unit 31 to correct the measure of length L20 calculated based on the data detected by sensors 30, 33, 35 and to compensate the elastic elongation effect of rope 9. Indeed, starting from a condition with completely contracted kelly rods and holding rotary 10 still, if the kelly rods are caused to move downward into the drilling site by unwinding rope 9, control unit 31 increases the calculated length L20 by adding the quantity of unwound rope 9 measured by means of sensor 30, which measures, for example, the rotations of winch 8. Since the quantity of unwound rope 9 is added to the elastic elongation, which is not measured by the sensors 30, 33 and 35, when great depths are reached, operators can check whether the actual position of drilling tool 15 is at a lower height than the calculated one. In the constructive variant in which vibration sensor 36 is also used (in addition to sensors 30, 33, 35), every time that, during the downward movement of drilling tool 15, a kelly rod reaches the limit stop, sensor 36 sends a signal to control unit 31, which corrects the value of length L20 assigning to this length a given corrected value corresponding to the number of kelly rods that have slid out and are in a mutual maximum length condition. As the downward movement goes on, control system 31 keeps increasing the calculated length L20 based on the parameters detected by sensor 30 until another slidable kelly rod reaches its limit stop, thus generating a new collision. When this collision is detected, control system 31 corrects again the calculated length L20 of drill string 20, assigning a correct value thereto. Therefore, thanks to the use of vibration sensor 36, the error in the calculation of the position of the kelly rods is greatly reduced, as it is affected only by the elastic elongations of rope 9 taking place during the extension of one single kelly rod, and not any more by the elastic elongation of rope 9 taking place during the extension of all the kelly rods of drill string 20.

Naturally, the principle of the invention being set forth, embodiments and implementation details can be widely changed relative to what described above and shown in the drawings as a mere way of non-limiting example.

The invention claimed is:

1. A system for detecting at least one mechanical locking position of a drill string in a soil drilling machine;

said machine comprising:

a mast;

a rotary which is mounted so as to slide along said mast;

a winch around which a flexible pulling member is wound;

a drill string which is rotated by said rotary, which crosses said rotary, and which hangs from said flexible pulling member; said drill string comprises at least one pair of kelly rods which are axially slidable inside one another so as to be moved to at least one mutual mechanical locking position, in which said drill string is at least partially supported by said rotary and said at least one pair of kelly rods is designed to move is moved from a decoupled condition, in which a transmission of a downward thrust between said kelly rods is prevented and a mutual sliding is allowed, to a coupled condition, in which a transmission of a downward thrust between said kelly rods is allowed substantially without mutual sliding; movement from said decoupled condition to said coupled condition occurring when said rotary causes said drill string to rotate in a drilling rotation direction;

said system comprising:

sensor means for detecting first data indicating a position assumed by the top of the drill string and second data indicating a position assumed by the bottom of said drill string;

a control unit which is configured to calculate an estimated length of said drill string based on said data and to compare said estimated length with at least one reference length value, wherein said at least one pair of kelly rods is in said at least one mechanical locking position; and signaling means which are configured to signal when said estimated length corresponds to said at least one reference length value.

2. The system according to claim 1, wherein said sensor means comprise a first sensor which is configured to detect a first information representing a position assumed by said rotary along said mast, and a second sensor which is configured to detect an information representing that said drill string is at least partially supported by said rotary.

3. The system according to claim 1, wherein said sensor means comprise a winding sensor which is configured to detect an information representing a length of the flexible pulling member that is unwound from the winch.

4. The system according to claim 1, wherein said control unit is configured to calculate the difference between said estimated length and said at least one reference length value; said signaling means being configured to provide a perceivable signaling of said difference.

5. The system according to claim 1, wherein said sensor means comprise a vibration sensor which is configured to detect vibration data representing vibrations propagated through said drill string; said control unit being configured to correct said estimated length determining that a respective pair of kelly rods has reached a maximum mutual distance position, said maximum mutual distance position being determined based on the estimated length of said drill string and whether said vibration data exceed a threshold value.

6. A soil drilling machine comprising a system according to claim 1.

7. A method for detecting at least one mechanical locking position of a drill string in a soil drilling machine; said machine comprising:

a mast;

a rotary which is mounted so as to slide along said mast;

a winch around which a flexible pulling member is wound;

a drill string which is capable of being caused to rotate by said rotary, which crosses said rotary, and which hangs from said flexible pulling member; said drill string comprises at least one pair of kelly rods which are axially slidable inside one another so as to be moved to at least one mutual mechanical locking position, in which said drill string is at least partially supported by said rotary and said at least one pair of kelly rods is moved from a decoupled condition, in which a transmission of a downward thrust between said kelly rods is prevented and a mutual sliding is allowed, to a coupled condition, in which a transmission of a downward thrust between said kelly rods is allowed substantially without mutual sliding; the movement from said decoupled condition to said coupled condition occurring when said rotary causes said drill string to rotate in a drilling rotation direction;

said method comprising the following operating steps:

detecting first data indicating a position assumed by the top of the drill string and second data indicating a position assumed by the bottom of said drill string;

calculating the estimated length of said drill string based on said data and comparing said estimated length with at least one reference length value, wherein said at least one pair of kelly rods is in said at least one mechanical locking position;

signaling when said estimated length corresponds to said at least one reference length value.

8. The method according to claim 7, wherein said first data comprise a first information representing a position assumed by said rotary along said mast and a second information representing that said drill string is at least partly supported by said rotary.

9. The method according to claim 8 and comprising, furthermore, the operating steps of:

detecting vibration data representing vibrations propagated through said drill string;

correcting said estimated length determining that a respective pair of kelly rods has reached a maximum mutual distance position, said maximum mutual distance position being determined based on the estimated length of said drill string and whether said vibration data exceed a threshold value.

10. The method according to claim 7, wherein said second data comprise a winding information representing a length of the flexible pulling member that is unwound from the winch.

11. The method according to claim 7 comprising, furthermore, the operating steps of calculating a difference between said estimated length and said at least one reference length value; and providing a perceivable signaling of said difference.

* * * * *